US010888151B1

(12) United States Patent
Dimitriou

(10) Patent No.: US 10,888,151 B1
(45) Date of Patent: Jan. 12, 2021

(54) PAINT BRUSH AND METHOD OF MAKING THE SAME

(71) Applicant: John Dimitriou, Englewood Cliffs, NJ (US)

(72) Inventor: John Dimitriou, Englewood Cliffs, NJ (US)

( * ) Notice: Subject to any disclaimer, the term of this patent is extended or adjusted under 35 U.S.C. 154(b) by 0 days.

(21) Appl. No.: 17/007,208

(22) Filed: Aug. 31, 2020

Related U.S. Application Data

(62) Division of application No. 16/784,400, filed on Feb. 7, 2020, now Pat. No. 10,791,824.

(51) Int. Cl.
*A46B 9/00* (2006.01)
*A46D 3/00* (2006.01)

(52) U.S. Cl.
CPC ..... *A46B 9/005* (2013.01); *A46D 3/00* (2013.01); *A46B 2200/202* (2013.01)

(58) Field of Classification Search
CPC ..... A46B 9/005; A46B 2200/202; A46D 3/00
USPC ..... 15/244.3
See application file for complete search history.

(56) References Cited

U.S. PATENT DOCUMENTS 2,648,861 A * 8/1953 Hardman ..... A46B 3/02 15/192
3,386,119 A * 6/1968 Shulman ..... A46B 15/00 15/193
3,711,886 A * 1/1973 Strauss ..... A47L 13/20 15/229.8
4,525,890 A * 7/1985 Peerman ..... A46B 3/02 15/193
5,689,872 A * 11/1997 Forsline ..... A46D 1/00 29/515
5,964,508 A * 10/1999 Maurer ..... A46B 3/06 15/167.1
7,294,297 B2 * 11/2007 Weihrauch ..... B29C 45/00 264/102
8,439,452 B2 * 5/2013 Cox ..... A46B 9/028 300/21
9,089,200 B2 * 7/2015 Telwar ..... A46D 1/04
10,477,951 B2 * 11/2019 Chan ..... A46D 3/047
2004/0205922 A1 * 10/2004 Cowdery ..... A46B 7/04 15/235
2014/0304931 A1 * 10/2014 Cox ..... A46B 11/00 15/159.1
2019/0365087 A1 * 12/2019 Boutorine ..... B32B 5/26

* cited by examiner

*Primary Examiner* — Randall E Chin
(74) *Attorney, Agent, or Firm* — Michael J. Feigin, Esq.; Feigin and Fridman LLC

(57) ABSTRACT

A paint brush and method of making the same is disclosed. The paint brush includes a velutinous painting portion having a body including a cavity and an opening, an insert disposed within the body, a handle coaxial with the body, and a ferrule connecting the body to the handle to seal the insert within the body. The body includes an interior face having a rigid surface and an exterior face having velutinous members. The velutinous members include animal fur, synthetic filaments, and/or natural fibers. The method includes sewing fabric having a velutinous surface into a pocket having a cavity, positioning the pocket so the velutinous surface faces an exterior of the pocket, inserting a semi-rigid foam insert into the cavity to form a velutinous painting portion, and connecting the velutinous painting portion to a paint brush handle with a ferrule to form a paint brush having a velutinous painting portion.

10 Claims, 6 Drawing Sheets

PAINT BRUSH AND METHOD OF MAKING THE SAME

FIELD OF THE DISCLOSED TECHNOLOGY

The disclosed technology relates to paint brushes. More specifically, the disclosed technology relates to a paint brush including a velutinous painting portion and a method of making the paint brush.

BACKGROUND OF THE DISCLOSED TECHNOLOGY

Conventional paint brushes have painting portions made up of rigid bristles or filaments. Indeed, these painting portions typically include a variety of stiff natural or synthetic bristles or filaments attached to a handle by means of a ferrule. When performing brushstrokes with painting portion having these sorts of bristles, they typically only bend where they connect to the ferrule and are not themselves flexible. The limited flexibility of these types of rigid and stiff bristles limits the way in which a user can transfer paint onto a substrate surface, leaving a need for a more flexible, pliable, and supple paint brush that is capable of transferring paint onto the substrate surface differently, thereby enabling a user to apply paint to the substrate surface using unique approaches.

Accordingly, there is a need for a paint brush including a velutinous painting portion that enables a user to apply paint to a substrate surface differently and a method of making the same.

SUMMARY OF THE DISCLOSED TECHNOLOGY

Disclosed herein is a paint brush with a velutinous painting portion. The paint brush includes a body including a cavity defining an interior volume and an opening having a perimeter edge. The opening provides access to the interior volume of the cavity. The body includes an interior face having a rigid surface and an exterior face having a surface including upright flexible velutinous members. A semi-rigid insert is disposed within the interior volume of the body. The semi-rigid insert includes a size less than or equal to a size of the interior volume of the cavity. A handle is coaxially disposed relative to the body. A ferrule connects the body and the handle to each other to seal the semi-rigid insert within the unitary body.

In embodiments, the unitary body comprises a distal end including an arcuate edge and a proximal end including the opening of the cavity. The proximal end is connected to the ferrule to seal the opening.

In some embodiments, the upright flexible velutinous members extend from the proximal end to the distal end of the body and over the entire exterior face of the body. In other embodiments, the velutinous members extend outwardly past a widest portion of the handle.

In certain embodiments, the semi-rigid insert is coterminous with the perimeter edge of the opening of the unitary body.

In embodiments, the velutinous members comprise animal fur selected from the group consisting of lamb fur, sheep fur, mink fur, rabbit fur, fox fur, chinchilla fur, coyote fur, muskrat fur, raccoon fur, skunk fur, beaver fur, ermine fur, fisher fur, fitch fur, lynx fur, marten fur, nutria fur, opossum fur, sable fur, squirrel fur, tanuki fur, and weasel fur. In some embodiments, the velutinous members comprise synthetic hairs. In other embodiment, the velutinous members comprise fur and/or synthetics designed to and created for the purposes of mimicking fur.

Further disclosed herein is a method of making a paint brush having a velutinous painting portion. The method includes sewing a piece of fabric having a velutinous surface into a pocket defining a cavity including an interior volume and an opening. The opening provides access to the interior volume of cavity. The fabric includes a hard surface opposite the velutinous surface, a first side edge, a second side edge, the first side edge opposite the second side edge, a third side edge, and a fourth side edge, the third side edge opposite the fourth side edge. The method also includes turning the pocket inside out to position the velutinous surface on an exterior of the pocket and the hard surface on an interior of the pocket, inserting a semi-rigid foam insert into the cavity of the pocket to form a velutinous painting portion, and connecting the velutinous painting portion to a paint brush handle with a ferrule to seal the opening of the pocket with the ferrule and to seal the semi-rigid foam insert within the pocket.

In embodiments, the pocket is formed by folding the fabric in half onto itself about a central axis of the fabric to fold the velutinous surface in half onto itself, the first side edge in half onto itself, and the second side edge in half onto itself.

In some embodiments, the sewing comprises stitching a seam connecting the first side edge to itself and stitching a seam connecting the second side edge to itself to form the cavity between the first side edge and the second side edge and to position the velutinous surface on an interior of the pocket and the hard surface on an exterior of the pocket.

In other embodiments, the velutinous painting portion is connected to the paint brush handle such that the velutinous painting portion is coaxial with the handle and the opening of the pocket is aligned with a body of the handle.

In certain embodiments, the method includes cutting the fabric from a larger piece fabric so that the first side edge and the second side edge are longer than the third side edge and the fourth side edge.

In embodiments, the method includes cutting a triangular piece of fabric from a center of the first side edge and a center of the second side edge to form a cut-out on the first side edge and a cut-out on the second side edge, wherein the cut-out on the first side edge and the cut-out on the second side edge are aligned and define a central lateral line about which the rectangular piece is folded onto itself, the central lateral line extending from the first side edge to the second side edge about the central axis.

In some embodiments, the method includes cutting the semi-rigid foam insert from a larger piece of semi-rigid foam insert to generate a size that is approximately less than or equal to the size of the interior volume of the cavity.

For purposes of this disclosure, the following definitions are used. "Coaxial" is defined as "having a common axis." "Radial" is defined as of or arranged like the radii of a circle or diverging from a common center." "Cavity" is defined as "an unfilled space within a mass, such as a hollowed-out space." "Pocket" is defined as "a small structure formed by sewing, joining, adhering such that it includes an opening on an end or side." "Coterminous" is defined as "having the same boundaries or extent in space as an object, area, region, or point." "Unitary" is defined as "an undivided unit or whole unit." "Hard" is defined as "not easily penetrated, or not easily yielding to pressure." "Fabric" is defined as "a textile, or a flexible material consisting of a network of natural or artificial fibers made through weaving, knitting, spreading, crocheting, or bonding." "Rigid" is defined as "devoid of flexibility." "Semi-rigid" is defined as "rigid to some degree or in some parts." "Velutinous" is defined as "covered with a fine and dense pubescence of fur and synthetics designed to and created for the purpose of mimicking fur." "Pubescence" is defined as "soft down or fine, flexible, and supple filaments or hairs." "Filament" is defined as "a slender threadlike object or fiber." "Painting portion" is defined as "the brush head or portion of a paintbrush that holds the paint." "Ferrule" is defined as "a ring, cap, or sleeve placed around a pole, shaft, or a handle for joining or binding one part to another."

Any device or step to a method described in this disclosure can comprise or consist of that which it is a part of, or the parts which make up the device or step. The term "and/or" is inclusive of the items which it joins linguistically and each item by itself. "Substantially" is defined as at least 95% of the term being described and/or "within a tolerance level known in the art and/or within 5% thereof. Any device or aspect of a device or method described herein can be read as "comprising" or "consisting" thereof.

DETAILED DESCRIPTION OF EMBODIMENTS OF THE DISCLOSED TECHNOLOGY

Figure 1:
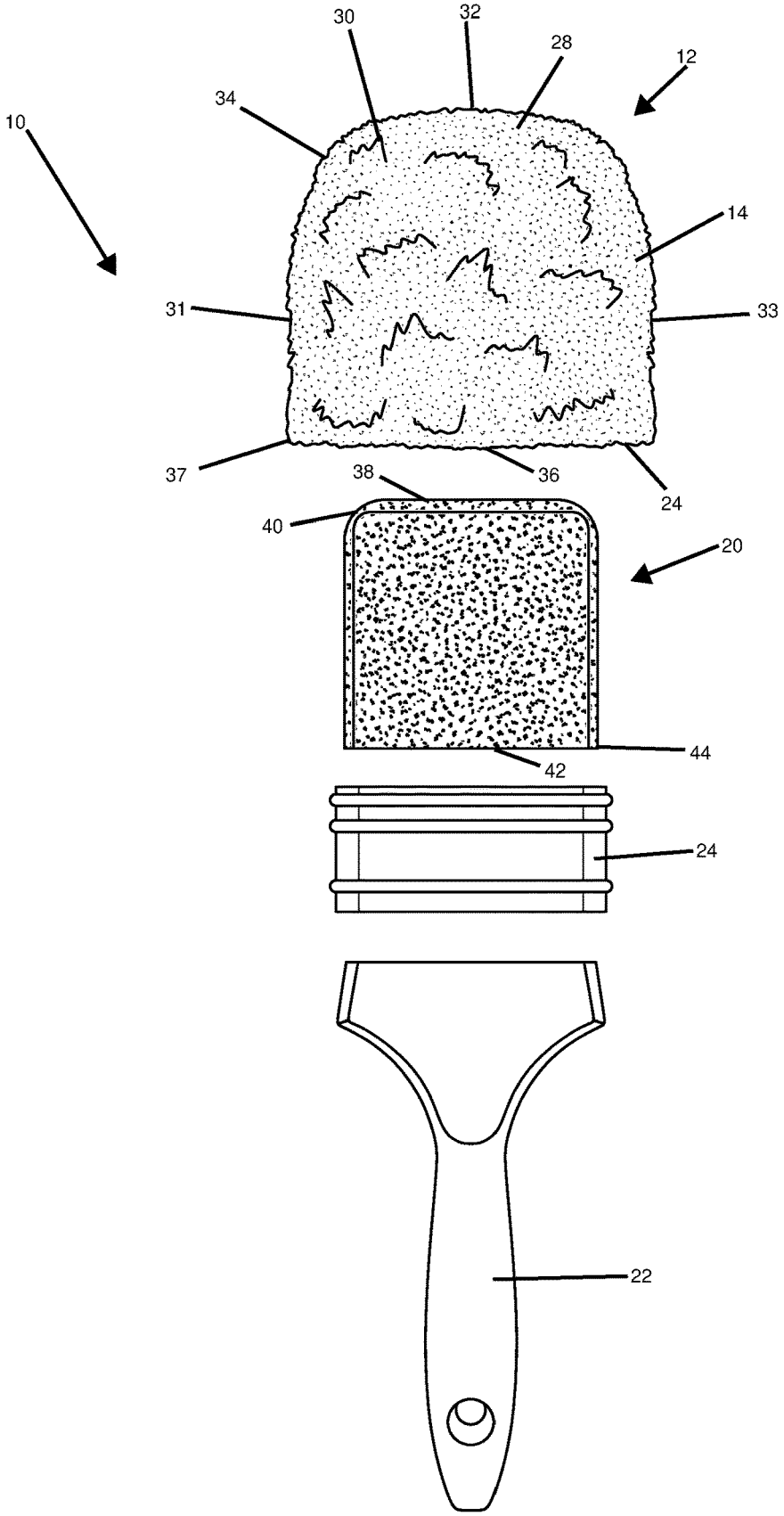
FIG. 1 shows an exploded elevation view of the paint brush, illustrating the components of the paint brush and one manner in which they assemble to form the paint brush according to one embodiment of the present disclosed technology.

The present disclosed technology provides a paint brush having a velutinous surface and a method of making the same. The paint brush includes a velutinous painting portion having a body including a cavity and an opening, an insert disposed within the body, a handle coaxial with the body, and a ferrule connecting the body to the handle to seal the insert within the body. The body includes an interior face having a rigid surface and an exterior face having velutinous members. The velutinous members include flexible and supple animal fur, synthetic filaments, and/or natural fibers. The method includes sewing fabric having a velutinous surface into a pocket having a cavity, positioning the pocket so the velutinous surface faces an exterior of the pocket, inserting a semi-rigid foam insert into the cavity to form a velutinous painting portion, and connecting the velutinous painting portion to a paint brush handle with a ferrule to form a paint brush having a velutinous painting portion. Reference is made herein to the attached drawings. Like reference numerals are used throughout the drawings to depict like or similar elements of the paint brush and the method of making the same. The figures are intended for representative purposes only and should not be considered to be limiting in any respect. Embodiments of the present disclosed technology will become clearer in view of the following description of the figures.

Referring now to FIG. 1, there is shown an exploded elevation view of the paint brush, illustrating the components of the paint brush and one manner in which they assemble to form the paint brush according to one embodiment of the present disclosed technology. In embodiments, the present disclosed technology comprises a paint brush 10 comprising a velutinous painting portion 12 including a body 14 having a cavity 116 (see FIG. 4C) including an opening 120 (see FIG. 4C), a semi-rigid insert 20 disposed within the body 14, a handle 22 coaxial with the body 14, and a ferrule 24 connecting the body 14 and the handle 22 to each other to seal the semi-rigid insert 20 within the body 14.

In embodiments, the body 14 comprises a first side 31, a second side 33, a distal end 32 including an arcuate edge 34, a proximal end 36 including a rectangular edge 37, a longitudinal length extending from the distal end 32 to the proximal end 36, and a lateral width extending from the first side 31 to the second side 33. The proximal end 36 connects to the ferrule 24 to seal the opening 120. The cavity 116 defines an interior volume and includes a perimeter edge 24 defining the opening 120. The opening 120 provides access to the interior volume of the cavity 116. The body 14 includes an interior face (not shown) extending from the distal end 32 to the proximal end 36 and an exterior face 28 also extending from the distal end 32 to the proximal end 36. The exterior face 28 is opposite the interior face. The interior face comprises a rigid surface and the exterior face 28 comprises a surface having a plurality of upright flexible velutinous members 30. In embodiments, the body 14 is unitary in structure.

The velutinous members 30 are attached to the exterior face 28 and extend outwardly from the exterior face 28. In some embodiments, the velutinous members 30 extend radially outwardly relative to a center of the body 14. In other embodiments, the velutinous members 30 extend perpendicular relative to the surface of the exterior face 28. The velutinous members 30 extend from the proximal end 36 to the distal end 32 and across the surface of the exterior face 28 of the body 14. In embodiments, the velutinous members 30 extend over the entire surface of the exterior face such that they are coterminous with the perimeter edge 24 of the opening 120 of the body 14. The velutinous members 30 extend outwardly past a widest portion of the handle 22.

In embodiments, the velutinous members 30 comprise animal fur including lamb fur, sheep fur, mink fur, rabbit fur, fox fur, chinchilla fur, coyote fur, muskrat fur, raccoon fur, skunk fur, beaver fur, ermine fur, fisher fur, fitch fur, lynx fur, marten fur, nutria fur, opossum fur, sable fur, squirrel fur, tanuki fur, weasel fur, and/or the like. In some embodiments, the velutinous members 30 comprise synthetic filaments including rayon, nylon, polyester, acrylic, and/or the like. In other embodiments, the velutinous members 30 comprise natural fibers including silk, cotton, hemp, jute, cashmere, camel hair, ramie, and/or the like. In certain embodiments, the velutinous members 30 comprise filaments including fur and synthetics designed to and created for the purpose of mimicking fur.

The insert 20 comprises an upper end 38 including an arcuate edge 40 and a lower end 42 including a rectangular edge 44. The insert 20 includes substantially the same size as the cavity 116 such that the insert 20 friction fits within the cavity 116. In some embodiments, the insert 20 includes a size that is less than or equal to a size of the interior volume of the cavity 116 to provide a space in between the insert 20 and the interior face of the body 14. In embodiments, the insert 20 is coterminous with the perimeter edge 24 of the body 14. The insert 20 is semi-rigid to provide flexibility to the painting portion 12 while the paint brush 10 is in use. In some embodiments, the insert 20 comprises a foam material, such as a reticulated foam, an open-cell-structured foam containing pores, or a closed-cell foam that does not include interconnected pores. For example, in one embodiment, the insert 20 comprises a sponge. In embodiments, the body 14, the semi-rigid insert 20, the handle 22, and the ferrule 24 are connected to one another to form the paint brush 10 by means of adhesives, staples, nails, tape, or a combination thereof.

Figure 2A:
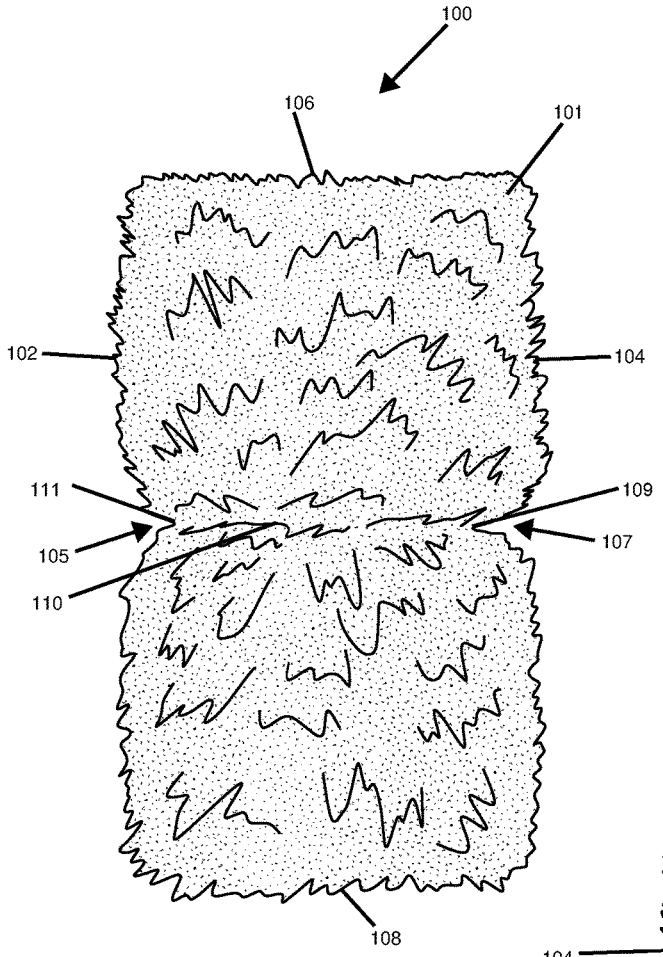
FIG. 2A shows a top plan view of the velutinous fabric, illustrating the velutinous fabric before being stitched to form the pocket of the velutinous painting portion according to one embodiment of the present disclosed technology.
Figure 2B:
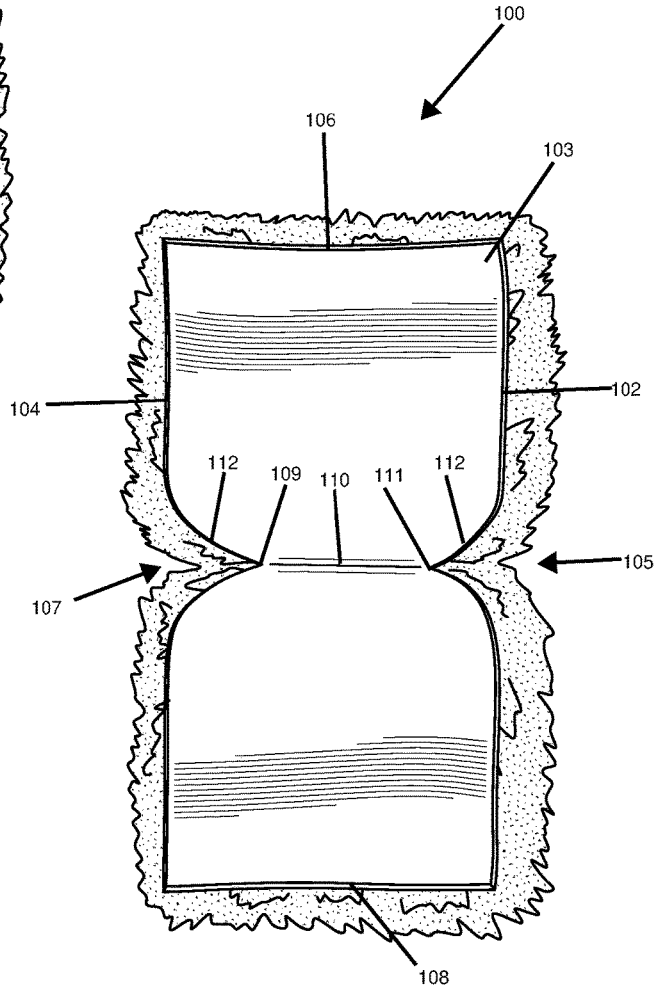
FIG. 2B shows a bottom plan view of the velutinous fabric, illustrating the velutinous fabric before being stitched to form the pocket of the velutinous painting portion according to one embodiment of the present disclosed technology.

Referring now to FIGS. 2A and 2B, simultaneously, FIG. 2A shows a top plan view of the velutinous fabric, illustrating the velutinous fabric before being stitched to form the pocket of the velutinous painting portion according to one embodiment of the present disclosed technology. FIG. 2B shows a bottom plan view of the velutinous fabric, illustrating the velutinous fabric before being stitched to form the pocket of the velutinous painting portion according to one embodiment of the present disclosed technology. The present disclosed technology also provides a method of making a paint brush having a velutinous painting portion. In embodiments, the method includes cutting a rectangular piece of fabric 100 including a velutinous surface 101, a rigid surface 103, a first side edge 102, a second side edge 104, a third side edge 106, and a fourth side edge 108 from a larger piece fabric such that the first side edge 102 and the second side edge 104 are longer than the third side edge 106 and the fourth side edge 108. In some embodiments, the method includes fabricating the rectangular piece of fabric 100 to include the velutinous surface 101, the rigid surface 103, the first side edge 102, the second side edge 104, the third side edge 106, and the fourth side edge 108 such that the first side edge 102 and the second side edge 104 are longer than the third side edge 106 and the fourth side edge 108. The velutinous surface 101 is opposite the rigid surface 103. The first side edge 102 is opposite the second side edge 104. The third side edge 106 is opposite the fourth side edge 108.

In some embodiments, the method includes cutting a first triangular portion from a center 105 of the first side edge 102 and a second triangular portion from a center 107 of the second side edge 104 to form a cut-out 111 on the first side edge 102 and a cut-out 109 on the second side edge 104. The cut-outs 111, 109 are aligned and define a central lateral line 110 about which the fabric 100 is to be folded onto itself. The cut-outs 111, 109 include arcuate edges 112 that enable the fabric 100 to fold onto itself more easily. The central lateral 110 line extends from the first side edge 102 to the second side edge 104 about a central axis of the rectangular piece of fabric 100.

Figure 3:
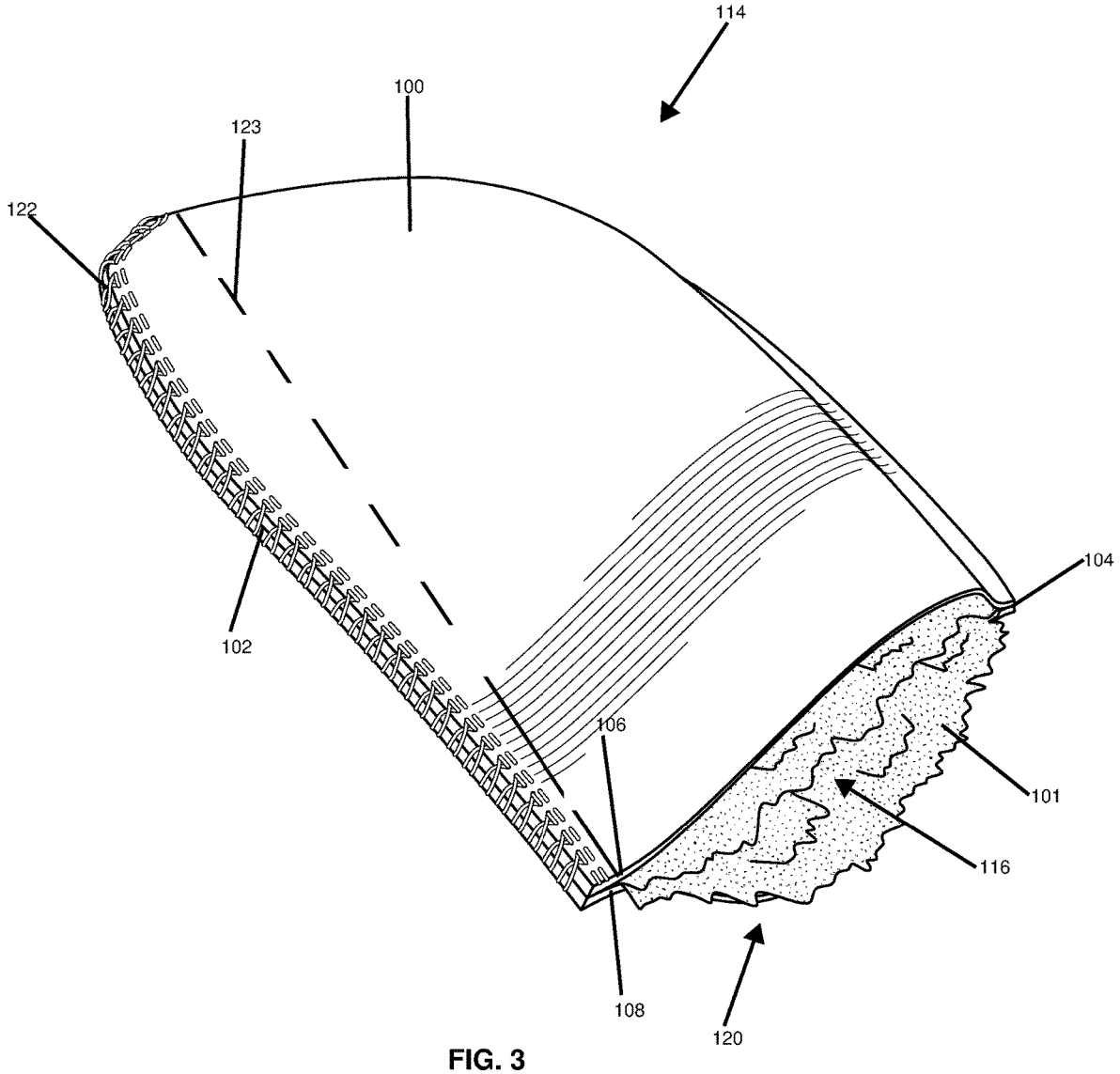
FIG. 3 shows a perspective view of the pocket inside out, illustrating the manner in which the velutinous fabric is sewed to form the pocket of the velutinous painting portion according to one embodiment of the present disclosed technology.

Referring now to FIG. 3, there is shown a perspective view of the pocket inside out, illustrating one manner in which the velutinous fabric is sewed to form the pocket of the velutinous painting portion according to one embodiment of the present disclosed technology. In embodiments, the method comprises sewing the fabric 100 into a pocket 114 to form pocket 114 including a cavity 116 defining an interior volume and having an opening 120 that provides access to the interior volume of the cavity 116. The pocket 114 shape is formed by folding the fabric 100 in half onto itself about a central axis of the fabric 100 to fold the velutinous surface 101 in half onto itself, the first side edge 102 in half onto itself, the second side edge 104 in half onto itself, and the third side edge 106 onto the fourth side edge 108. The pocket 114 structure is finally formed by stitching a seam 122 to connect the first side edge 102 to itself and stitching a seam to the second side edge 104 to itself, thereby forming the cavity 116 between the first side edge 102 and the second side edge 104, positioning the velutinous surface 101 toward an interior of the pocket 114, and positioning the hard surface 103 toward an exterior of the pocket 114. In some embodiments, tape 123 is positioned over the seams 122 to prevent adhesives, paints, and solvents from penetrating the velutinous surface 101 and/or leaking into the cavity 116.

Figure 4A:
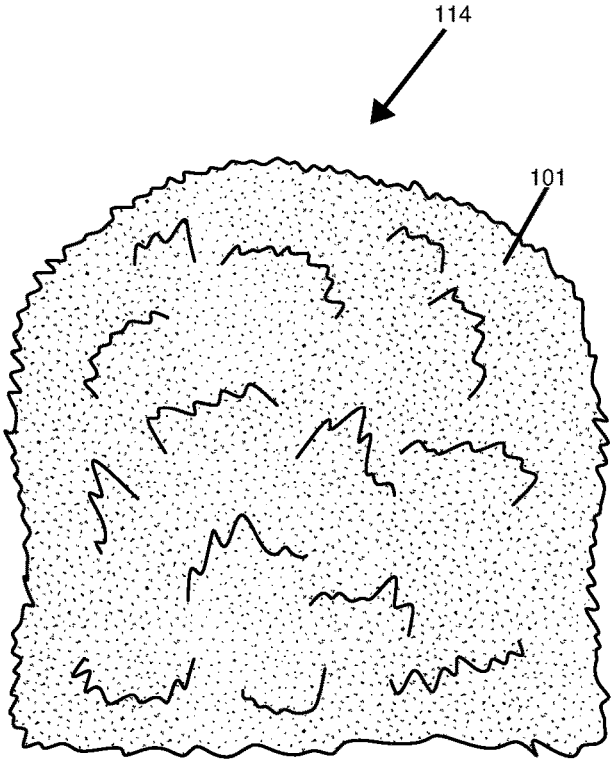
FIG. 4A shows an elevation view of the pocket, illustrating the pocket prior to insertion of the semi-rigid insert according to one embodiment of the present disclosed technology.
Figure 4B:
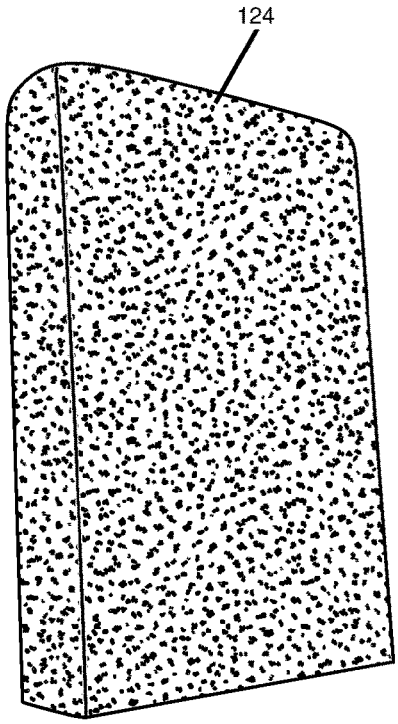
FIG. 4B shows a perspective view of the semi-rigid insert, illustrating the semi-rigid insert prior to insertion into the interior cavity of the pocket according to one embodiment of the present disclosed technology.
Figure 4C:
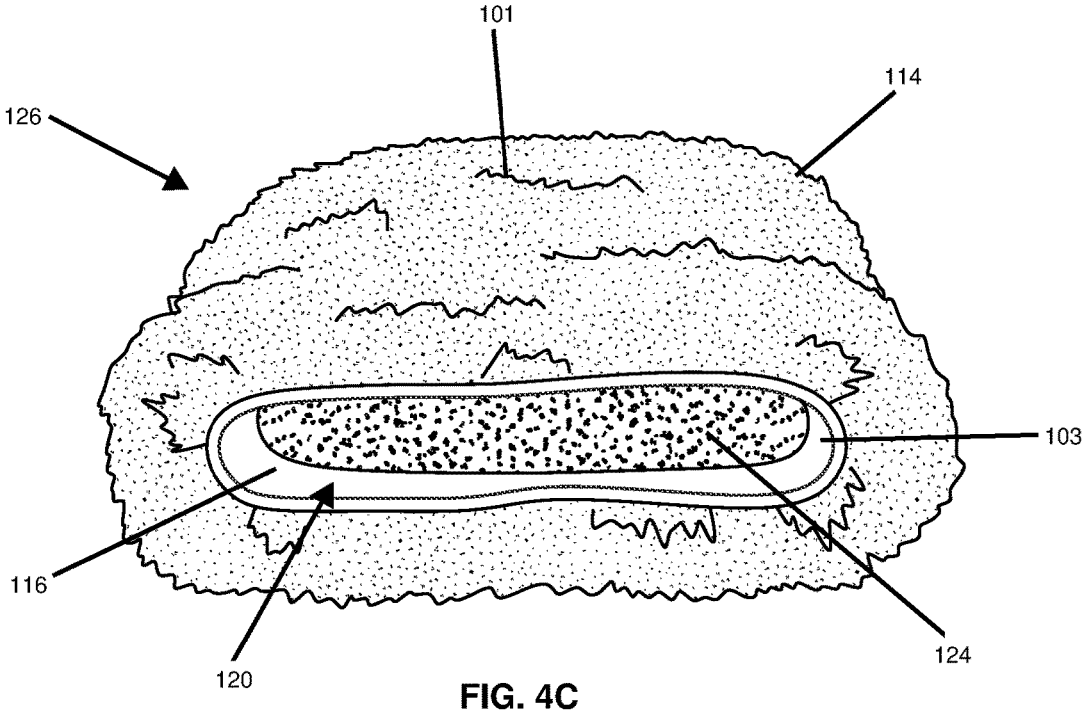
FIG. 4C shows a bottom view of the velutinous painting portion, illustrating semi-rigid insert inserted into the interior cavity of the pocket to form the velutinous painting portion.

Referring now to FIG. 4A-4C, simultaneously, FIG. 4A shows an elevation view of the pocket, illustrating the pocket prior to insertion of the semi-rigid insert according to one embodiment of the present disclosed technology. FIG. 4B shows a perspective view of the semi-rigid insert, illustrating the semi-rigid insert prior to insertion into the interior cavity of the pocket according to one embodiment of the present disclosed technology. FIG. 4C shows a bottom view of the velutinous painting portion, illustrating semi-rigid insert inserted into the interior cavity of the pocket to form the velutinous painting portion. The method further comprises turning the pocket 114 inside out to position the velutinous surface 101 toward an exterior of the pocket 114 and the hard surface 103 toward an interior of the pocket 114, and inserting a semi-rigid foam insert 124 into the cavity 116 of the pocket 114 via the opening 120 to form a velutinous painting portion 126. In some embodiments, the method includes cutting the semi-rigid foam insert 124 from a larger piece of semi-rigid foam insert to generate a size that is approximately less than or equal to the size of the interior volume of the cavity 116. In this way, the semi-rigid foam insert 124 friction fits within the cavity 116. In embodiments, the semi-rigid foam insert 124 is attached to the cavity 116 by adhesives, staples, nails, tape, or a combination thereof.

Figure 5:
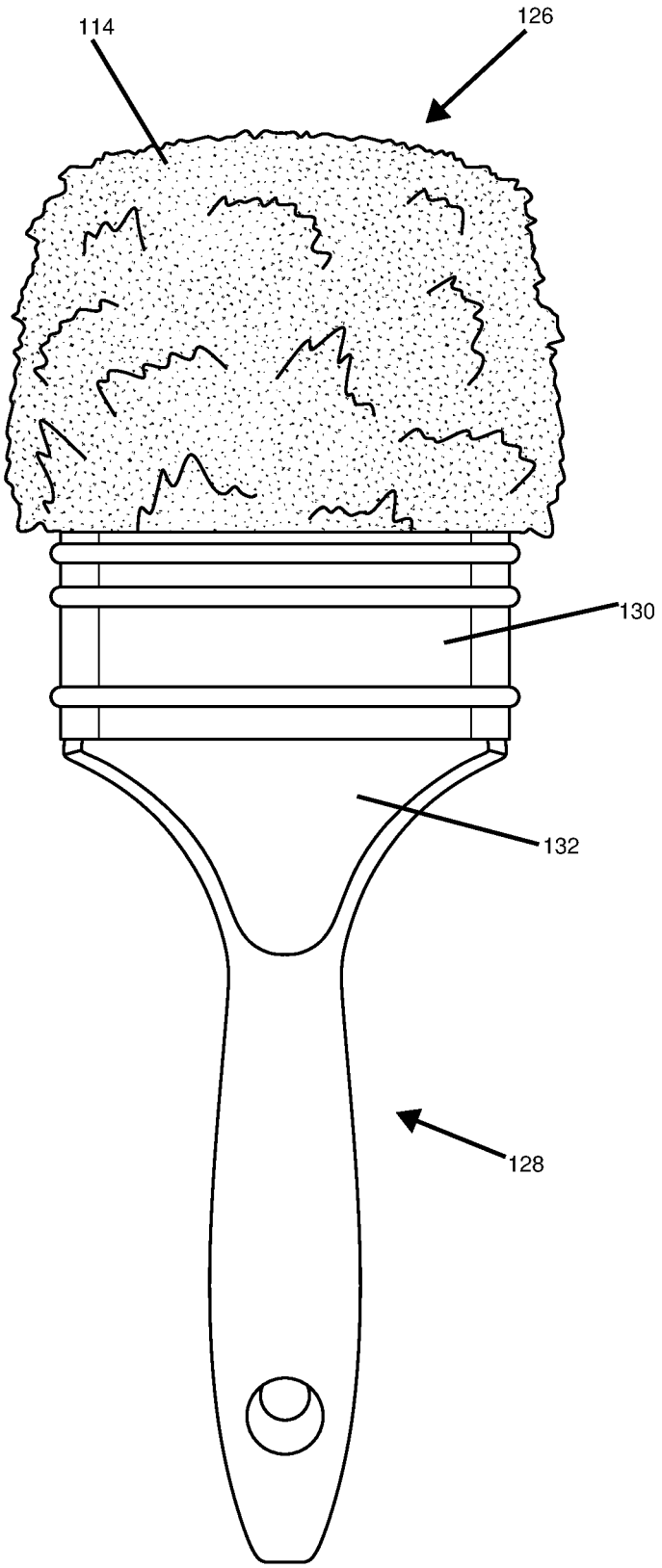
FIG. 5 shows a partial exploded elevation view of the paint brush, illustrating the velutinous painting portion being attached to the handle according to one embodiment of the present disclosed technology.

Referring now to FIG. 5, there is shown a partial exploded elevation view of the paint brush, illustrating the velutinous painting portion being attached to the handle according to one embodiment of the present disclosed technology. The method further comprises connecting the velutinous painting portion 126 to a paint brush handle 128 with a ferrule 130 to seal the opening 120 (see FIG. 4C) of the pocket 114 with the ferrule 130 and to seal the semi-rigid foam insert 124 (see FIG. 4C) within the pocket 114 to form a paint brush having a velutinous painting portion. The velutinous painting portion 126 is connected to the paint brush handle 128 such that the velutinous painting portion 126 is coaxial with the handle 128 and the opening 120 of the pocket 114 is aligned with a body 132 of the handle 128. In embodiments, the velutinous painting portion 126 is connected to the handle 128 by adhesives, staples, nails, tape, or a combination thereof.

Figure 6:
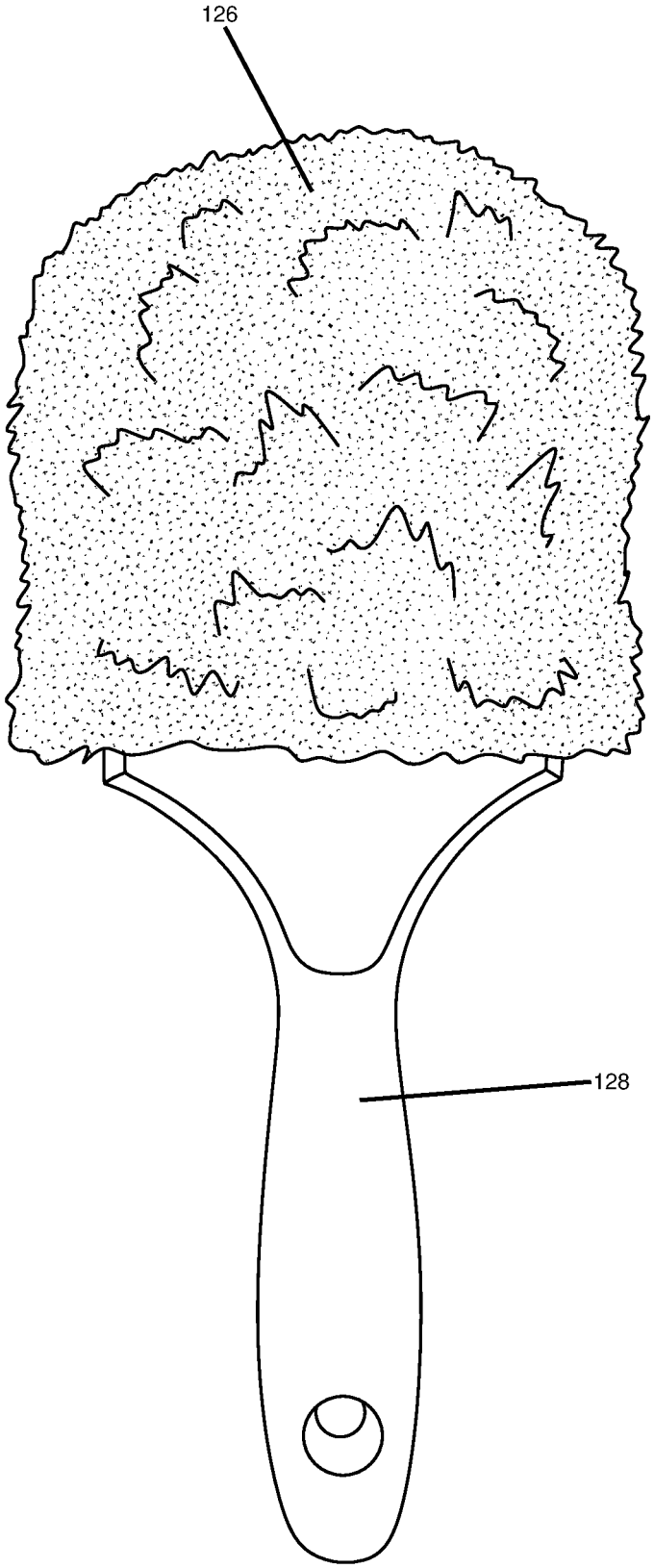
FIG. 6 shows an elevation view of the paint brush, illustrating the arrangement of the paint brush after complete assembly according to one embodiment of the present disclosed technology.

Referring now to FIG. 6, there is shown an elevation view of the paint brush, illustrating the arrangement of the paint brush after complete assembly according to one embodiment of the present disclosed technology. In embodiments, after the velutinous painting portion 126 is attached to the paint brush handle 128 with the ferrule 130 (see FIG. 5), the velutinous painting portion 126 is positioned over the ferrule 130 such that the ferrule 130 does not interfere with operation of the paint brush.

The present technology can be carried out with one or more of the embodiments described. The drawings show embodiments with the understanding that the present description is to be considered an exemplification of the principles and is not intended to be exhaustive or to limit the disclosure to the details of construction. The arrangements of the components are set forth in the following description or illustrated in the drawings.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A paint brush with a velutinous painting portion, comprising:

a painting portion comprising a unitary body including a cavity defining an interior volume and an opening having a perimeter edge, the opening providing access to the cavity, the unitary body including an interior face having a rigid surface and an exterior face having a surface including a plurality of upright flexible velutinous members;

a semi-rigid insert disposed within the interior volume of the body, the semi-rigid insert including a size less than or equal to a size of the interior volume of the cavity;

a handle connected coaxially to the body; and a ferrule connecting the handle to the body to seal the semi-rigid insert within the body.

2. The paint brush of claim 1, wherein the body comprises a distal end and a proximal end, the distal end including an arcuate edge and the proximal end including the opening, the proximal end connected to the ferrule to seal the opening.

3. The paint brush of claim 2, wherein:

the body comprises a unitary body; and the semi-rigid insert comprises a foam-like material.

4. The paint brush of claim 3, wherein the plurality of upright flexible velutinous members extend from the proximal end to the distal end and over the entire exterior face of the body.

5. The paint brush of claim 4, wherein the plurality of upright flexible velutinous members extend outwardly past a widest portion of the handle.

6. The paint brush of claim 5, wherein the semi-rigid foam insert is coterminous with the perimeter edge of the opening of the body.

7. The paint brush of claim 4, wherein the plurality of upright flexible velutinous members comprise animal fur selected from the group consisting of lamb fur, sheep fur, mink fur, rabbit fur, fox fur, chinchilla fur, coyote fur, muskrat fur, racoon fur, skunk fur, beaver fur, ermine fur, fisher fur, fitch fur, lynx fur, marten fur, nutria fur, opossum fur, sable fur, squirrel fur, tanuki fur, and weasel fur.

8. The paint brush of claim 5, wherein the plurality of upright flexible velutinous members comprise synthetic filaments selected from the group consisting of rayon, nylon, polyester, and acrylic.

9. The paint brush of claim 6, wherein the plurality of upright flexible velutinous member comprise natural fibers selected from the group consisting of silk, cotton, hemp, jute, cashmere, camel hair, and ramie.

10. The paint brush of claim 7, wherein the plurality of upright flexible velutinous members comprise a filament selected from the group consisting of fur and synthetics designed to and created to mimic fur.

* * * * *